US005655274A

United States Patent [19]

Kunstadt

[11] Patent Number: 5,655,274

[45] Date of Patent: Aug. 12, 1997

[54] ONE-PIECE RESILIENT FASTENER LOOP

[76] Inventor: Robert M. Kunstadt, 470 W. End, No. 8A, New York, N.Y. 10024

[21] Appl. No.: 622,585

[22] Filed: Mar. 26, 1996

[51] Int. Cl.[6] ..... A44B 13/00; A44B 21/00

[52] U.S. Cl. ..... 24/668

[58] Field of Search ..... 24/662, 666, 668, 24/678

[56] References Cited

U.S. PATENT DOCUMENTS

| | | | |
|---|---|---|---|
| 403,609 | 5/1889 | Pickhardt | 24/668 |
| 717,371 | 12/1902 | Faulkner | 24/678 |
| 1,079,330 | 11/1913 | Flagg | 24/668 |
| 1,232,502 | 7/1917 | Comstock, Sr. | 24/668 |
| 1,628,638 | 5/1927 | Anderson | 24/668 |
| 1,762,264 | 6/1930 | Domkee | 24/668 |
| 1,785,735 | 12/1930 | Heather | 24/668 |
| 1,804,259 | 5/1931 | Joyce | 24/678 X |
| 1,890,692 | 12/1932 | Mosgrove | 24/668 |
| 3,577,609 | 5/1971 | Gottfried | 24/678 |
| 3,911,537 | 10/1975 | Mazur | 24/668 |
| 4,935,997 | 6/1990 | Hirsch | 24/668 |

OTHER PUBLICATIONS

Etamco Catalog, p. 2 (1982?).

Mississippi Trading "Twist Loop" (1996?).

*Primary Examiner*—Peter M. Cuomo

*Assistant Examiner*—Robert J. Sandy

[57] ABSTRACT

A loop is constructed so as to slip easily over a button shank, but to resist unwanted detachment. This is accomplished by providing a coil of wire adjacent the opening for retaining the button shank, which acts as a spring to enhance the resilience of the loop at precisely the needed region. The loop can be made of a one-piece welded construction, thereby mitigating concerns that have arisen about use of a separate encasement.

5 Claims, 1 Drawing Sheet

ONE-PIECE RESILIENT FASTENER LOOP

FIELD OF THE INVENTION

This invention relates to the field of resilient loops (clips) for use in garments, for removable attachment to a projection therefrom, such as a button; or otherwise for attachment of two parts of an assembly to be removably joined.

PRIOR ART

It is desirable to have a resilient loop for attachment of a garment feature, such as a shoulder strap, to a projection such as a button. Therefore, in the prior art there are taught means to make a loop with separable wire fingers, that are restrained to a suitable range of motion by an encasement (cap) made of a metal stamping. See, e.g., U.S. Pat. No. 4,935,997 to Hirsch.

However, making a two-piece construction has the disadvantage of requiring extra manufacturing steps. Additionally, there may be a customer concern that the separate encasement may become detached from the wire, possibly leading to consumer injuries (swallowing by small children).

One known solution has been to make a one-piece loop of a single piece of welded wire, that has a bight at one end to receive an overall strap and a bight at the other end to receive a button shank. However, such a loop, being of one piece, has relatively little flexibility compared to the loop with encasement.

Another proposed solution has been to join the wire ends at the overall strap bight region by interlocking twists of wire, so that the sides of the loop are permitted some freedom to move towards and away from each other in that region. However, this construction still suffers from the disadvantage that in the region of the loop encircling the button, where the flex action is most desired—to permit the loop to be snapped easily onto the button, but to resist unwanted detachment—the wire is still not flexible.

SUMMARY OF THE INVENTION

In the present invention, a loop is constructed so as to slip easily over a button shank, but to resist unwanted detachment. This is accomplished by providing a coil of wire adjacent the opening for retaining the button shank, which acts as a spring to enhance the resilience of the loop at precisely the needed region. The loop can be made of a one-piece welded construction, thereby mitigating concerns that have arisen about use of a separate encasement.

DETAILED DESCRIPTION OF THE INVENTION

Figure 2:
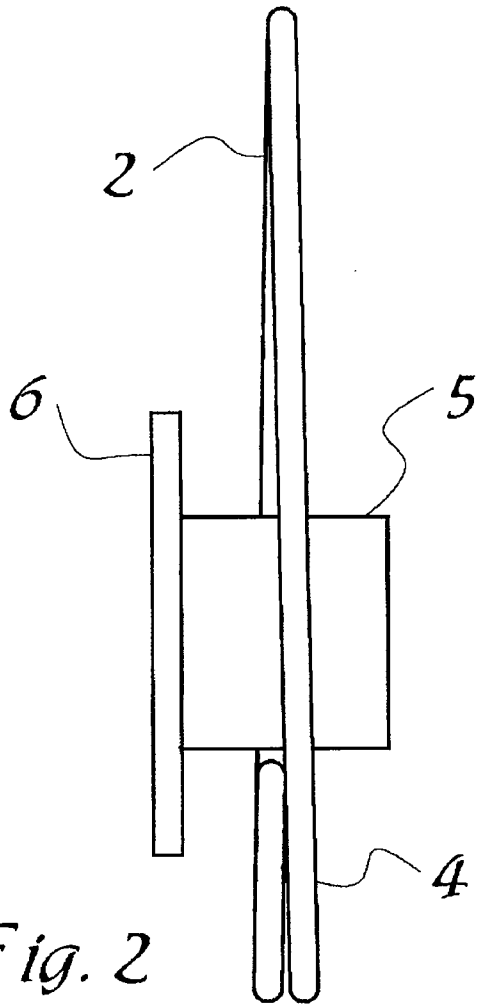
FIG. 2 a side elevation of a loop according to the invention.
Figure 1:
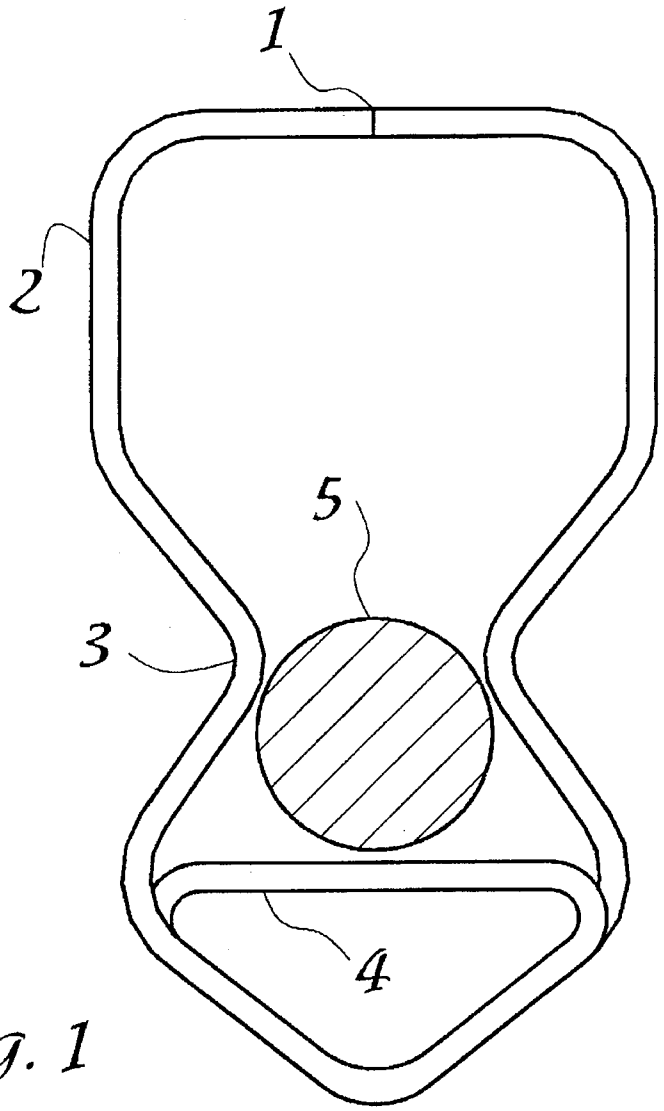
FIG. 1 a front elevation of a loop according to the invention, with a button shank in cross-section.

Referring now to FIGS. 1–2, the invention will now be described in detail.

FIG. 1 shows a loop according to the invention, made of wire from steel, brass, or other convenient material. Plastic may also be used. The cross-section of the wire need not be circular, it may be square or of other desired profiles. In the case of steel wire, the ends may be welded or otherwise fastened at joint 1. Such joint may be positioned elsewhere along the wire, if desired.

Bight 2 provides a region for attachment of an overall strap or other part to be fastened, and for passage of button head 6 as the loop is fastened and unfastened.

The loop is bent inwardly to form projections 3, which are suitably dimensioned to permit passage of button shank 5 (bearing button head 6) only upon the desired application of force, so as to prevent unwanted opening.

Coil 4 provides a stop for button shank 5, and importantly enhances the resilience of projections 3, by acting as a spring to permit motion of projections 3 toward and away from each other upon passage of button shank 5. Coil 4 need not be formed in the triangular shape shown, it may be circular or of other desired shape.

The invention is not limited to the exact embodiments shown, and may be realized in such other ways as will be apparent to the skilled artisan, utilizing the teachings of the invention.

I claim:

1. A loop for removable attachment to a button-type projection, said loop comprising:

a coiled spring having a first segment, a second segment and at least one turn disposed therebetween, said turn being at least 360°;

each of said segments extending from said turn and forming a resilient neck portion;

said first and second segments further extending from said neck portion to form a bight portion; and wherein said button-type projection being receivable in a first region between said bight and neck portions and further being forceably and reversibly passable through said neck portion to be removably receivable in a second region between said neck portion and a portion of said at least one turn.

2. A loop according to claim 1, said first and second segments being secured to each other.

3. A loop according to claim 1, said loop being a continuous loop.

4. A loop according to claim 2, said loop being a wire loop and said first and second segments being secured to each other by welding.

5. A loop according to claim 3, said loop being a plastic loop.

* * * * *